US007877880B2

(12) United States Patent
Royle

(10) Patent No.: US 7,877,880 B2
(45) Date of Patent: Feb. 1, 2011

(54) HAND HELD PERSONAL CARE APPLIANCE

(75) Inventor: Terence Gordon Royle, Hampshire (GB)

(73) Assignee: The Gillette Company, Boston, MA (US)

( * ) Notice: Subject to any disclaimer, the term of this patent is extended or adjusted under 35 U.S.C. 154(b) by 593 days.

(21) Appl. No.: 11/897,811

(22) Filed: Aug. 31, 2007

(65) Prior Publication Data

US 2009/0056139 A1 Mar. 5, 2009

(51) Int. Cl.
*A45D 27/28* (2006.01)
*A45D 27/29* (2006.01)

(52) U.S. Cl. ..... 30/537; 30/526; 30/541

(58) Field of Classification Search ..... 30/526, 30/535, 537, 541
See application file for complete search history.

(56) References Cited

U.S. PATENT DOCUMENTS 4,739,242 A * 4/1988 McCarty et al. ..... 30/DIG. 1
4,914,816 A * 4/1990 Fenn et al. ..... 30/45
5,029,973 A * 7/1991 Rink ..... 385/60
5,046,249 A * 9/1991 Kawara et al. ..... 30/45
5,138,245 A * 8/1992 Mattinger et al. ..... 30/DIG. 1
5,259,116 A * 11/1993 Laube ..... 30/216
5,318,356 A * 6/1994 Shelton ..... 30/537
5,459,927 A * 10/1995 Kauer et al. ..... 30/43.1
5,771,580 A * 6/1998 Tezuka ..... 30/43.92
5,791,050 A * 8/1998 Masi ..... 30/34.05
5,794,342 A 8/1998 Davey
5,966,821 A * 10/1999 Armbruster et al. ..... 30/537
6,096,264 A * 8/2000 Peifer ..... 30/541
6,112,414 A * 9/2000 Andis et al. ..... 30/231
6,151,785 A * 11/2000 Morris ..... 30/206
6,301,792 B1 * 10/2001 Speer ..... 30/541
6,662,453 B1 * 12/2003 Stuckey et al. ..... 30/298.4
6,666,875 B1 * 12/2003 Sakurai et al. ..... 30/DIG. 1
6,722,046 B2 * 4/2004 Evenson ..... 30/391
7,114,257 B1 * 10/2006 Ortega ..... 30/43.92
7,273,384 B1 * 9/2007 So ..... 439/172

(Continued)

FOREIGN PATENT DOCUMENTS

NL 8702810 6/1989

(Continued)

OTHER PUBLICATIONS

PCT International Search Report and Written Opinion dated Jan. 27, 2009 (13 pgs).

(Continued)

*Primary Examiner*—Jason Daniel Prone
(74) *Attorney, Agent, or Firm*—Ronald T. Sia; Kevin C. Johnson; Steven W. Miller

(57) ABSTRACT

A hand-held personal care appliance includes a handle accommodating a rechargeable power supply and having electrical contacts, an operating head detachably mountable on the handle and having contacts for connection to the contacts of the handle, and a charging device for recharging the power supply and having contacts for connection to the contacts of the handle. The operating head must be detached from the handle for recharging the power supply. Different operating heads may be mountable on the handle to form a vibrating safety razor, a hair trimmer, etc.

8 Claims, 6 Drawing Sheets

U.S. PATENT DOCUMENTS

| | | | | |
|---|---|---|---|---|
| 7,356,934 | B2 * | 4/2008 | McCambridge et al. | 30/537 |
| 7,484,982 | B1 * | 2/2009 | Royle | 439/311 |
| 7,513,361 | B1 * | 4/2009 | Mills, Jr. | 30/537 |
| 2001/0023538 | A1 * | 9/2001 | Muraguchi et al. | 30/43.92 |
| 2002/0116823 | A1 * | 8/2002 | Moser et al. | 30/43.92 |
| 2003/0037447 | A1 * | 2/2003 | Gruber et al. | 30/537 |
| 2003/0226258 | A1 | 12/2003 | Patrick | |
| 2004/0172831 | A1 * | 9/2004 | Paas et al. | 30/45 |
| 2005/0217115 | A1 | 10/2005 | Blaustein et al. | |
| 2006/0168816 | A1 | 8/2006 | Wetzell et al. | |
| 2007/0283565 | A1 * | 12/2007 | Ho | 30/43.92 |
| 2008/0052912 | A1 * | 3/2008 | Barry et al. | 30/537 |
| 2008/0209733 | A1 * | 9/2008 | Johnson | 30/526 |
| 2009/0056137 | A1 * | 3/2009 | Royle | 30/34.1 |
| 2009/0056141 | A1 * | 3/2009 | Barry et al. | 30/541 |
| 2009/0056148 | A1 * | 3/2009 | Royle | 30/277.4 |
| 2010/0217263 | A1 * | 8/2010 | Tukulj-Popovic | 606/133 |

FOREIGN PATENT DOCUMENTS

| | | |
|---|---|---|
| WO | WO 2005/077613 | 8/2005 |

OTHER PUBLICATIONS www.braun.com/na/cruzer/cruzer.html—Braun Cruzer product website. Product description (23 pgs).

* cited by examiner

HAND HELD PERSONAL CARE APPLIANCE

FIELD OF THE INVENTION

This invention relates to hand-held personal care appliances and in particular to such appliances equipped with rechargeable batteries.

BACKGROUND OF THE INVENTION

Various forms of hand-held personal care appliances with electrical devices powered from a rechargeable battery are known. When the battery charge is exhausted it is necessary to recharge the battery to enable further use of the appliance and different charging arrangements are also known. Some appliances are equipped with an electric socket into which a plug which is attached to a charging device by an electric cable, can be inserted. The electric socket is often located on a handle of the appliance. Charging devices are commonly powered from a mains supply, although only a low recharging voltage is connected to the appliance. With such an arrangement an appliance can be used while the battery is being recharged. From a safety point of view it is in some circumstances at least preferable that a battery-operated hand-held appliance can not be used when it is connected to equipment that is itself connected to a mains supply. Inductive charging devices are also in common use, in which case the appliance and the charging unit include induction coils so that charging can be carried out without need for a direct electrical connection between them. With an inductive charging arrangement an appliance can be completely sealed against water ingress, and can not be used whilst the battery is being recharged. However, the charging rate is generally slow and an induction coil can not be housed within a metal casing, such as a metal handle, which might be desirable from other design considerations. There is, therefore a need for an arrangement that allows the battery of a hand-held personal care appliance to be charged at high rate through a metal handle and which will ensure the appliance is not electrically connected to any equipment that may itself be connected to the mains supply, when the appliance is being used.

SUMMARY OF THE INVENTION

The present invention sets out to satisfy the need identified alone and in accordance with the invention there is provided a hand-held personal care appliance comprising: a handle including electrical contacts and accommodating a rechargeable power supply for supplying electric current to the electrical contacts; an operating head releasably engageable with the handle and including an electrical device to be operated by electric current supplied from the power supply, the operating head having electrical contacts for cooperation with the electrical contacts of the handle when the operating head is engaged with the handle; and a charging device for recharging the power supply, the charging device having electrical contacts engageable with the electrical contacts of the handle to deliver recharging current to the power supply.

In an appliance embodying the invention the electrical contacts on the handle employed for delivery of a charging current from the charging device to recharge the power supply are the same contacts as those which supply electric current to the operating head when the appliance is in use. As a consequence the operating head has to be disengaged from the handle before the handle can be connected to the charging device for recharging the power supply. Therefore, the appliance can not be used while the power supply is being recharged. In addition of a fast charging rate is possible because there is a direct electrical connection between the handle and the charging device, and there are no restrictions imposed on the material of the handle.

In a preferred construction the handle and the charging device have complementary coupling members, for example, complementary male and female coupling members of a bayonet coupling, for mechanically and electrically connecting the handle to the charging device for recharging the power supply. In a particular embodiment the female coupling member is provided at an end of the handle and includes a cylindrical sleeve portion with a bayonet slot therein, and a male member provided on the charging device includes a plug part that is engageable in the sleeve and has a projection for engagement with the bayonet slot.

A sealing arrangement can be provided for sealing the handle to the charging device externally of the electrical contacts. In particular the handle can be provided with an annular seal extending around the sleeve portion axially inwardly of the bayonet slot for cooperation with a cylindrical part surrounding the plug part on the charging device.

Conveniently the handle includes a switch arrangement for controlling the supply of electric current to the operating head in use of the appliance and/or for controlling supply of electric current to the power supply during recharging.

Various forms of operating head are possible. In one embodiment the operating head is a safety razor head and the electrical device is an electrically powered vibration generating device. Another operating head comprises a hair trimmer unit with a trimmer blade assembly, the electrical device comprising an electric motor for driving a blade of the blade assembly.

A full understanding of the invention will be gained from the detailed description which follows and in which reference is made to the accompanying drawings.

DETAILED DESCRIPTION OF THE INVENTION

Figure 1:
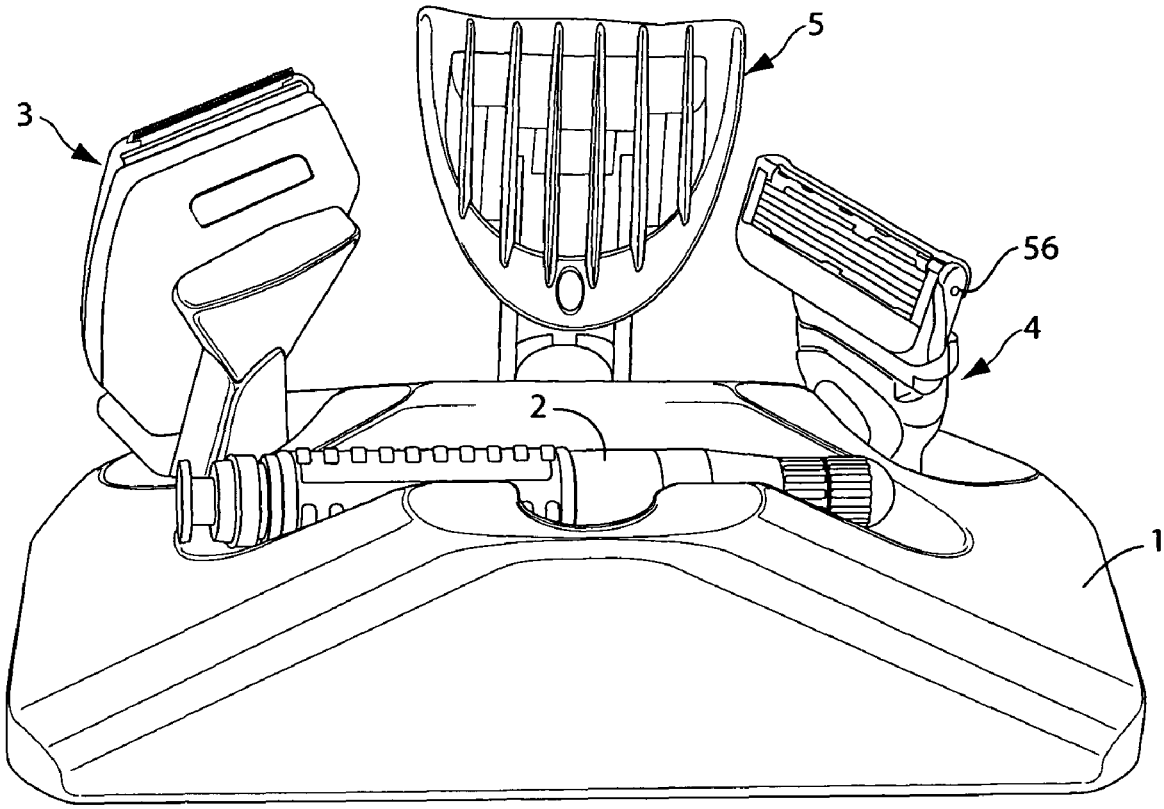
FIG. 1 is an illustration of a personal hair grooming apparatus incorporating a hand-held appliance according to the invention.
Figure 2:
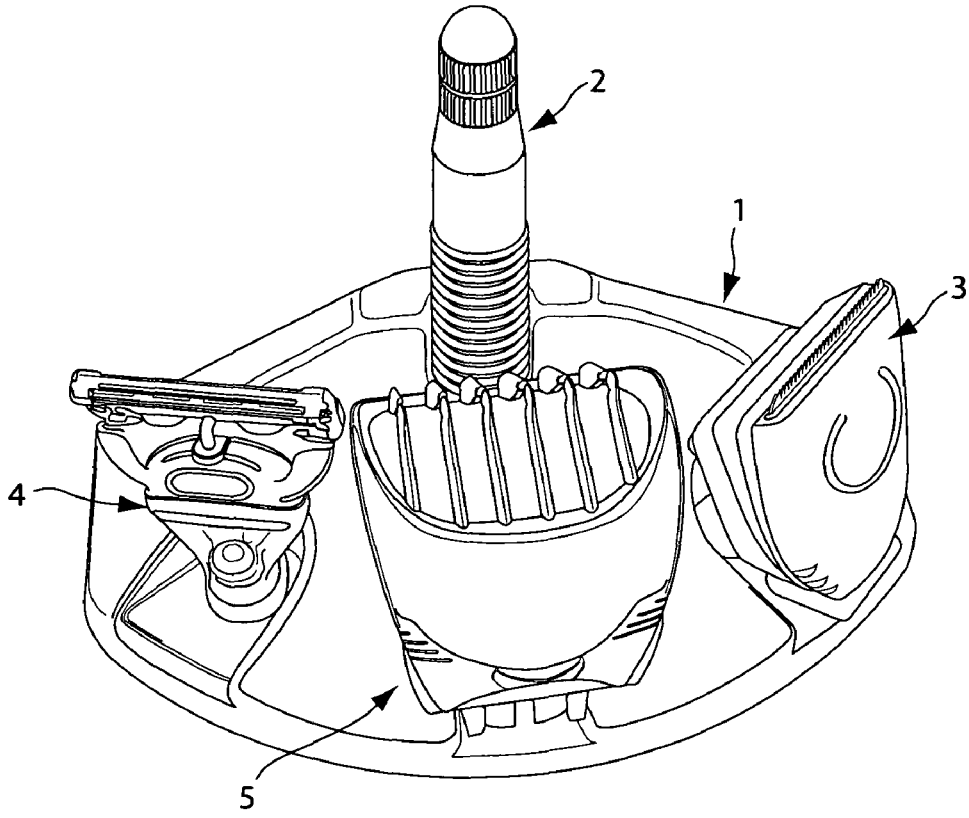
FIG. 2 shows the apparatus of FIG. 1, but with the handle of the appliance engaged with the recharging device for recharging a rechargeable battery housed in the handle.
Figure 3:
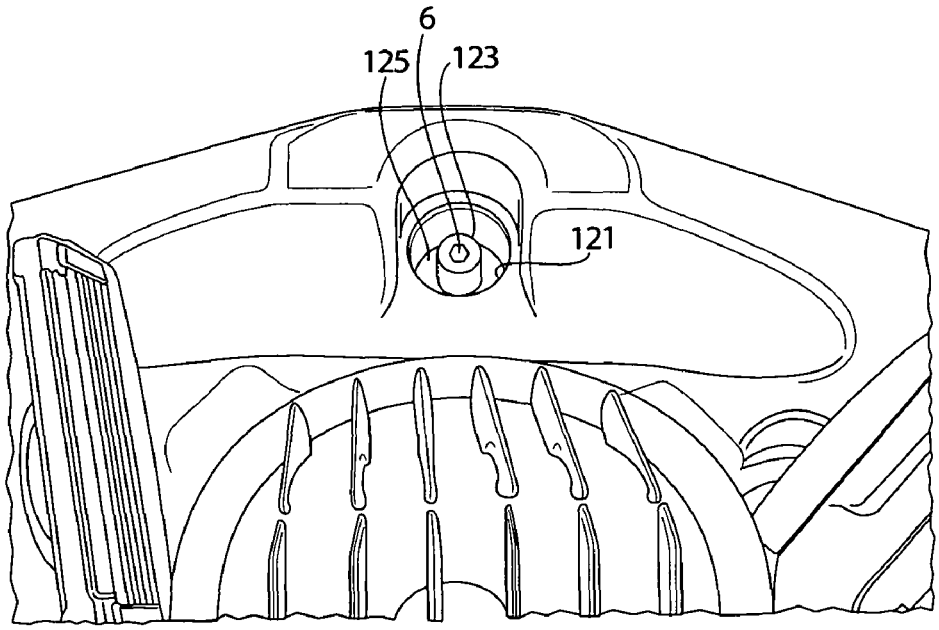
FIG. 3 is a view from above showing the connection socket of the recharging device.
Figure 4A:
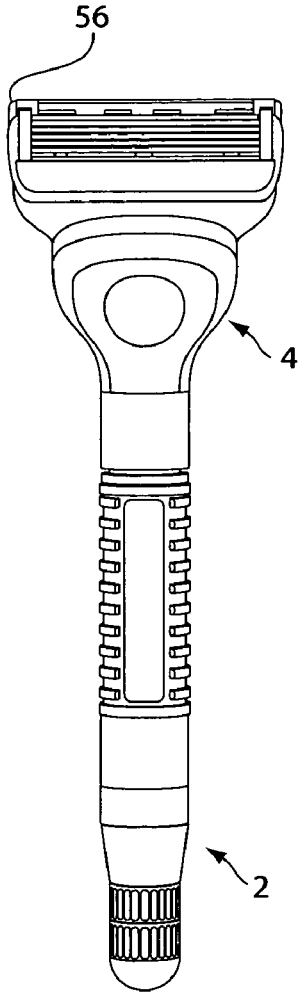
FIGS. 4*a*, 4*b*, and 4*c* are front elevations showing respective appliances assembled from the components of the apparatus illustrated in FIG. 1.
Figure 4B:
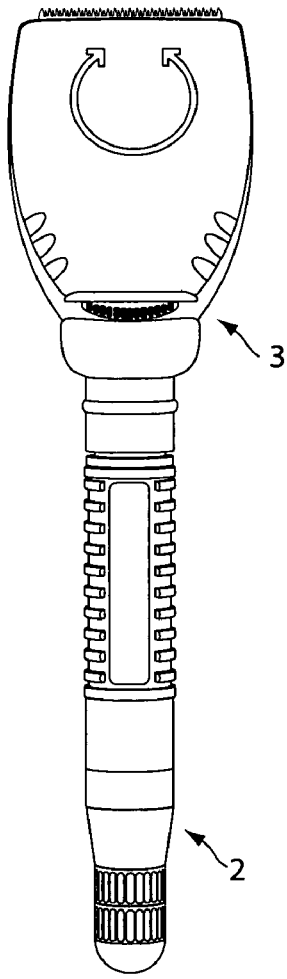
Figure 4C:
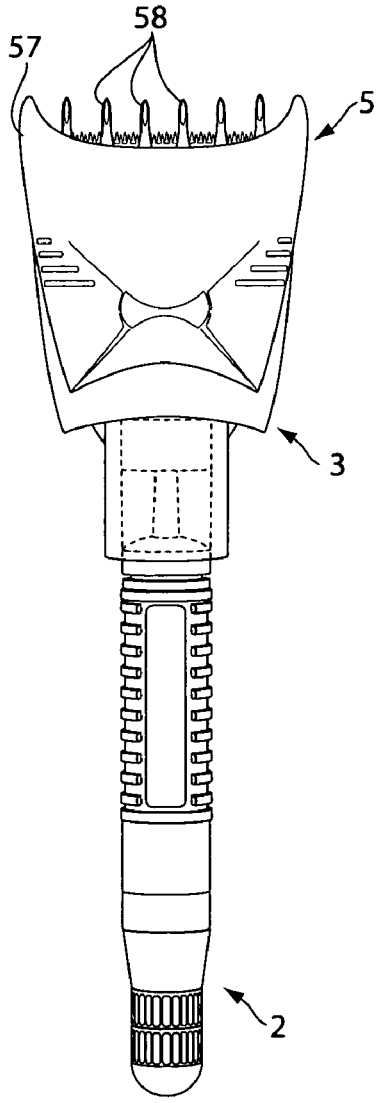
Figure 5:
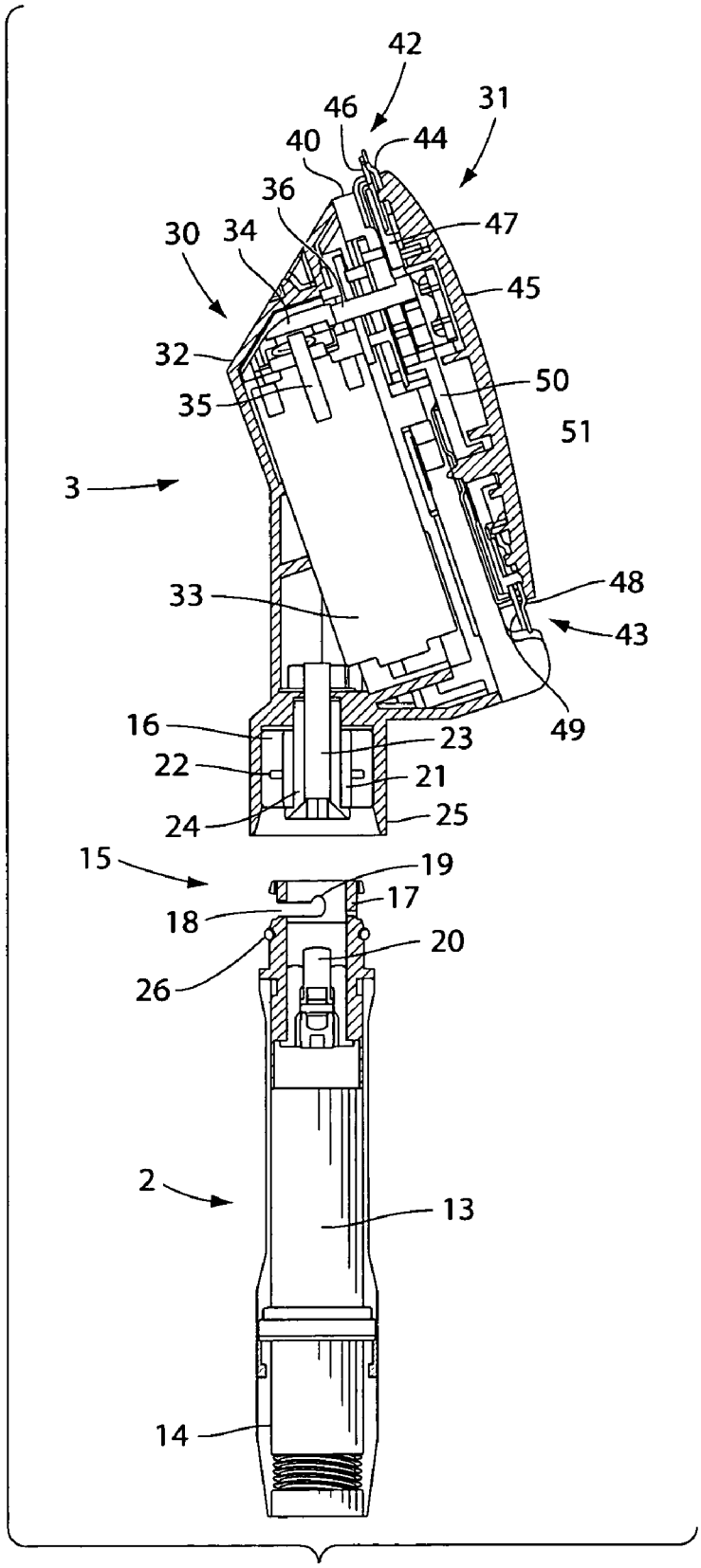
FIG. 5 is an axial section through the handle and an operating head in the form of a hair trimming device.
Figure 6:
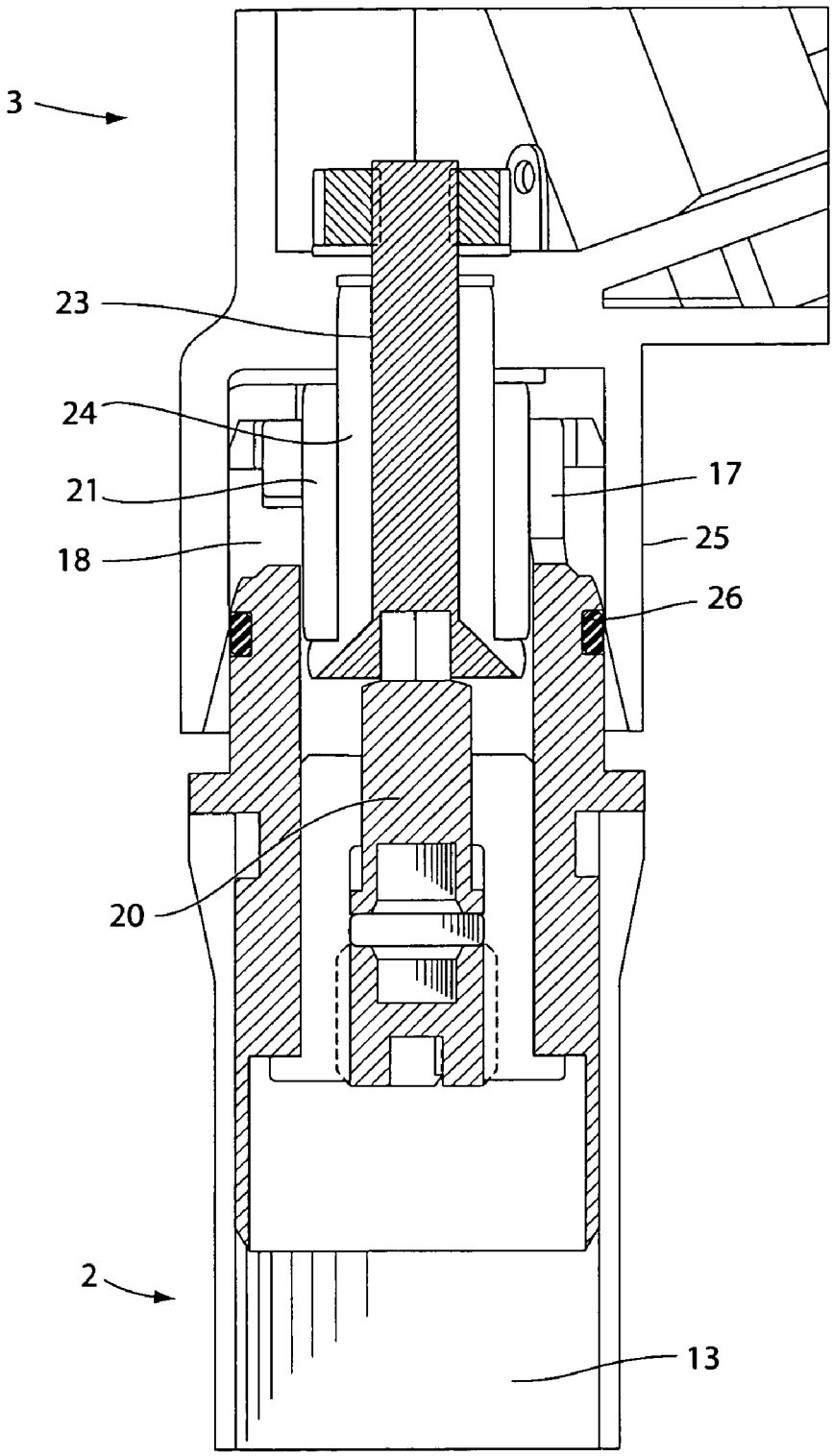
FIG. 6 is an enlarged axial cross-section through the assembled coupling region of the handle and the trimming device.

A personal care apparatus, in particular a personal grooming apparatus is illustrated in FIGS. 1 and 2. The components of the apparatus comprise a charging device 1, a handle 2, a hair trimming device 3, a safety razor head 4 and a trimmer comb attachment 5. The charging device 1 has the form of a base that provides a storage holder for the other components and for this purpose is provided with recessed holding regions for the handle 2 and the operating heads 3, 4, and a stand for the comb attachment 5. The charging device comprises a battery charger housed within the base casing, and a recharging socket 6 for the handle to plug into as further described below. The trimming device 3 and the safety razor head 4 are detachably mountable on the handle for assembly of respective hand-held grooming appliances, namely a hair trimmer as shown in FIG. 4*b*, and a vibrating safety razor as shown in FIG. 4*a*. In addition the comb attachment 5 can be fitted onto the trimming device 3 to form a modified trimming device as shown in FIG. 4*c*. The hair trimming device 3 and the handle 2 are illustrated in more detail FIG. 5. The handle 2, which forms a power supply unit, includes a battery compartment in which a rechargeable battery 13 is accommodated, and a switch arrangement 14 for controlling supply of electric current from the battery 13 to the trimming device 3 when mounted to the handle. A coupling is provided for electrically and mechanically connecting the handle to the trimming device and comprises a female coupling member 15 on the handle 2 and a male coupling member 16 on the trimming device 3. The assembled coupling is shown on an enlarged scale in FIG. 6. The female coupling member 15 includes a sleeve portion 17 located at the upper end of the handle and provided with a pair of symmetrical bayonet slots 18 with locking recesses 19 at their ends. Positioned centrally within the sleeve portion 17 is a first electrical contact 20 in the form of a pin which is spring-loaded and urged axially towards the upper end of the handle. The male coupling member 16 has a plug part 21 adapted to mate with the female coupling member by sliding engagement in the sleeve portion 17, and the plug part has a pair of diametrically opposed pin projections 22 arranged for cooperation with the respective bayonet slots 18. A second electrical contact 23 is located centrally within the plug part 21 with an electrical insulator 24 being disposed therebetween. When the male and female coupling members 15, 16 are fully engaged, the first and second contacts 20, 23 are pressed into close abutment due to the spring loading of the first contact, and this spring loading also serves to urge the pin projections 22 into the locking recesses 19 of the bayonet slots 18 to secure the trimming device 3 against unintentional disconnection from the handle 2. Additional spring forces can be applied by spring mounting the central contact 23 in the male plug part 21. The sleeve portion 17 and the plug part 21 form further electric contacts that cooperate to complete a circuit for the flow of electric current between the battery in the handle and the trimming device. Preferably the central contacts 20, 23 provide the positive polarity connection and the contacts 17, 21 the negative polarity connection of the electrical connector. The trimming device 3 includes a hood or shroud 25 which surrounds the plug part 21 for enclosing the male and female members of the bayonet coupling to preclude ingress of moisture to the electrical contacts. The female member carries an annular seal 26, such as an O-ring seal, disposed in a peripheral groove provided on the sleeve portion 17 axially inwardly of the bayonet slots 18, and the shroud 25 has a close fit over the seal 26 to ensure a watertight connection between the shroud and the handle when the male and female coupling members are engaged.

The bayonet coupling provides a firm and secure mechanical connection between the handle and the hair trimming device while also ensuring a good electrical connection between them. Furthermore, the coupling can be easily opened to separate the trimming device from the handle, to enable the battery to be recharged and to allow a different form of operating head to be operatively connected to the handle, such as a safety razor head 4 which is adapted to receive a conventional shaving cartridge 56 and which includes a motor for driving a vibration generating device, such as a coin motor. As will be appreciated the coupling employed to connect the safety razor head 4 to the handle 2 may be exactly as described above with respect to the trimming device 3, with the shroud 25 being sealed to the handle so that water can not reach the electrical contacts even when the razor head is completely immersed in water for rinsing the shaving cartridge.

The trimming device includes a drive unit 30 and a trimmer unit 31. The male coupling member 16 and the shroud 26 are provided on a housing 32 of the drive unit in which is housed an electric rotary motor 33 and a transmission mechanism 34 for converting rotary motion of a motor shaft 35 into reciprocation of a drive output member 36 in the form of a drive pin. The electric terminals of the motor are connected to the electrical contacts 21 and 23 of the trimming device for supply of current from the battery 13 in the handle for driving the motor. Connected to the front of the drive unit is a mounting plate 40 for the trimmer unit 31, the mounting plate being guided for up and down translatory movement relative to the drive unit for purposes which will become clear. The trimmer unit is held to the mounting plate 40 so that the trimmer unit 31 is able to rotate relative to the mounting plate 40 and hence also the drive unit 30. The trimmer unit includes a first trimmer blade assembly 42 and a second trimmer blade assembly 43. The first blade assembly 42 is comparatively long and straight and includes a first trimmer blade 44 fixedly mounted to a face plate 45 of the trimmer unit, and a second trimmer blade 46 guided for reciprocation relative to the first trimmer blade and attached to a blade driving element 47. The second blade assembly 43 is relatively short with a convex profile and includes a first trimmer blade 48 fixedly mounted to the face plate 45 and a second trimmer blade 49 guided for reciprocation along a curved path relative to the first trimmer blade 48 and attached to a blade driving element 50 which is mounted to the face plate 45 by a pivot 51. Each of the blade driving elements 47, 50 includes a slot in which the drive output pin 36 is engageable for reciprocating the blade driving element and also reciprocating the trimmer blade attached to the blade driving element.

Figure 7:
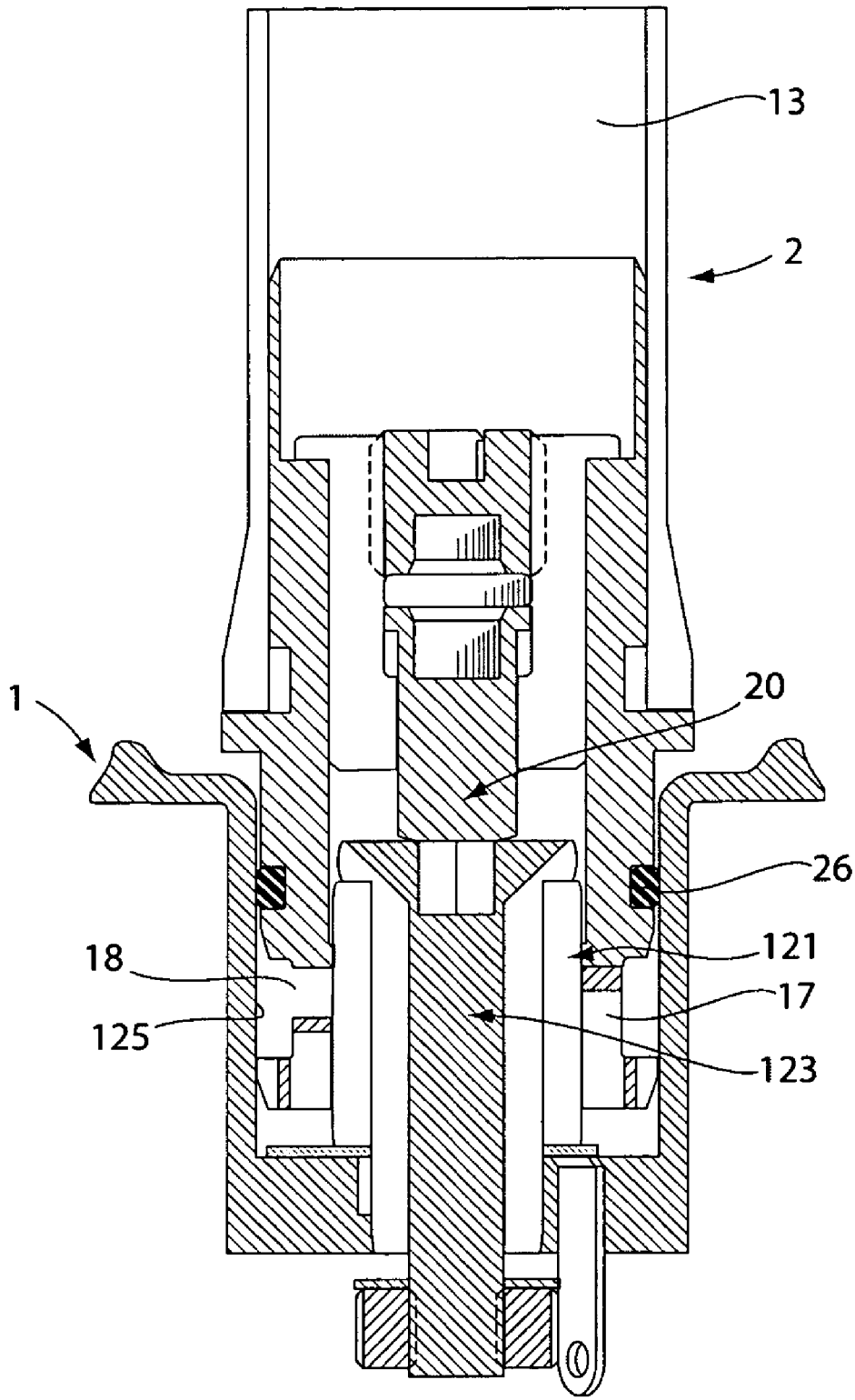
FIG. 7 is an enlarged axial cross-section through the engaged coupling region of the handle with the charging device.

When the mounting plate 40 is displaced upwardly relative to the drive unit the trimmer unit 31 can be rotated relative to the mounting plate to selectively adjust either the first blade assembly 42 or the second blade assembly 43 to the operative position, as respectively illustrated in FIGS. 7 and 8. Downward displacement of the mounting plate 40 and the trimmer unit then causes the drive output pin 36 to engage in the slot in the blade driving element 47 or 50 of the trimmer blade assembly 42 or 43 disposed in the operative position. Actuation of the motor 33 then puts the selected trimmer blade assembly into operation whilst the other trimmer blade assembly remains uncoupled from the drive output pin 36.

Although just two forms of operating head have been described it will be appreciated that other additional or alternative forms of operating head mountable on the handle 2 are possible, such as to provide a nose hair trimmer, an exfoliator, an eyebrow trimmer, a skin cream applicator, liquid dispenser, and/or a massager. It is also within the scope of the invention for there to be just one operating head.

The battery recharger base 1 provides a useful storage unit for the components, but most importantly acts as a recharging station for the battery accommodated in the handle 2. In addition to the necessary electrical recharging circuitry as known per se and not illustrated in the drawings, the recharging device is equipped with the socket 6 for the handle to plug into as illustrated in FIG. 2 and in more detail in FIG. 7. The socket has electrical contacts 121 and 123 which in size and configuration are the same as the contacts 21, 23 of the male coupling member 16 with which each of the operating heads 3 and 4 is provided. As a result, the handle 2 can be inverted and inserted into the socket so that a good mechanical and electrical connection is achieved through the bayonet coupling provided on the handle and the recharging device. In this way the contacts 17 and 20 of the handle are brought into good electrical contact with the corresponding contacts 121 and 123 of the socket for flow of recharging current to the rechargeable battery 13 in the handle 2. The switch 14 of the handle may be arranged to control the flow of the charging current. Alternatively a switch may be provided on the recharger base, or a separate switching arrangement could be included in the handle for this purpose. An indicator for indicating the charge state of the battery can also be provided on the base, if desired. The contacts 121, 123 are located within a cylindrical recess formed in the casing of the charging device 1, and the peripheral wall 125 of this recess serves to form a sealed enclosure around the contacts of the handle and the charging device, in the same way as described above in relation to the shroud 25 of the trimming device, as may be seen in FIG. 7.

When the battery 13 has been sufficiently recharged the handle 2 can be unplugged from the recharging base 1 and a selected operating head 3, 4 can be engaged onto the handle for use of the appliance. However, use of an appliance while the battery is in the process of being recharged is precluded. Since there is a direct electrical connection between the handle and the recharging device a fast charging rate can be assured. Furthermore, the handle can be manufactured with a metal casing and the cast of additional connections for recharging purposes is avoided by use of the contacts that deliver electric current from the handle to the operating head also for connecting the handle to the recharging device.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not be construed as an admission that it is prior art with respect to the present invention. To the extent that any meaning or definition of a term in this written document conflicts with any meaning of definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand-held personal care appliance comprising:

a handle including electrical contacts and accommodating a rechargeable power supply for supplying electric current to the electrical contacts;

an operating head releasably engageable with the handle and including an electrical device to be operated by the electric current supplied from the power supply, the operating head having electrical contacts for cooperation with the electrical contacts of the handle when the operating head is engaged with the handle; and a charging device for recharging the power supply, the charging device having electrical contacts engageable with the electrical contacts of the handle to deliver recharging current to the power supply wherein the handle and the charging device have complementary coupling members including the electrical contacts of the handle and the charging device for mechanically and electrically connecting the handle to the charging device for recharging the power supply, wherein the coupling members comprise male and female coupling members of a bayonet coupling, wherein the female coupling member is provided at an end of the handle and includes a cylindrical sleeve portion with at least one bayonet slot therein, and the male member is provided on the charging device and includes a plug part engageable in the sleeve portion and having a projection for engagement, and wherein said electrical contacts of the handle and the charging device comprise a spring loaded pin positioned within the sleeve portion urged axially towards the upper end of the handle, and a second electrical contact positioned within the plug part, such that when the coupling members are engaged the spring loaded pin abuts the second electrical contact.

2. The hand-held personal care appliance of claim 1, wherein the plug part has at least one projection for engagement with the at least one bayonet slot provided in the sleeve portion.

3. The hand-held personal care appliance of claim 1, including a sealing arrangement for sealing the handle to the charging device externally of the electrical contacts.

4. The hand-held personal care appliance of claim 1, wherein the handle comprises an annular seal extending around the sleeve portion.

5. The personal care appliance of claim 1, wherein the charging device is included in a storage stand having a holding region for receiving the operating head during periods of non-use.

6. The personal care appliance of claim 1, wherein the handle includes a switch arrangement for controlling a supply of the electric current to the operating head in use for the appliance and for controlling a supply of the electric current to the power supply during recharging.

7. The personal care appliance of claim 1, wherein the operating head is a safety razor head and an electrically driven vibration generating device.

8. The personal care appliance of claim 1, wherein the operating head comprises a hair trimmer unit with a trimmer blade assembly, and the electrical device comprises an electric motor for driving a blade element of the blade assembly.

* * * * *